US009682269B2

(12) United States Patent
Höglund

(10) Patent No.: US 9,682,269 B2
(45) Date of Patent: Jun. 20, 2017

(54) WEIGHT LIFTING ARRANGEMENT AND WEIGHT SELECTOR APPARATUS FOR A WEIGHT LIFTING ARRANGEMENT

(71) Applicant: Automatic Weightstack i Jönköping Kommanditbolag, Jönköping (SE)

(72) Inventor: Per Höglund, Jönköping (SE)

(73) Assignee: Automatic Weightstack i Jönköping Kommanditbolag, Jönköping (SE)

( * ) Notice: Subject to any disclaimer, the term of this patent is extended or adjusted under 35 U.S.C. 154(b) by 0 days.

(21) Appl. No.: 14/650,937

(22) PCT Filed: Jan. 9, 2014

(86) PCT No.: PCT/IB2014/000761

§ 371 (c)(1),
(2) Date: Jun. 10, 2015

(87) PCT Pub. No.: WO2014/118645

PCT Pub. Date: Aug. 7, 2014

(65) Prior Publication Data

US 2015/0306442 A1 Oct. 29, 2015

Related U.S. Application Data

(60) Provisional application No. 61/750,987, filed on Jan. 10, 2013.

(51) Int. Cl.
*A63B 21/00* (2006.01)
*A63B 21/062* (2006.01)

(52) U.S. Cl.
CPC ..... *A63B 21/062* (2013.01); *A63B 21/00069* (2013.01); *A63B 21/063* (2015.10); *A63B 21/0628* (2015.10); *A63B 2021/0623* (2013.01)

(58) Field of Classification Search
CPC ..... A63B 21/062; A63B 21/0626–21/0632; A63B 21/00065; A63B 21/075
See application file for complete search history.

(56) References Cited

U.S. PATENT DOCUMENTS 5,643,151 A 7/1997 Naimo
5,876,313 A 3/1999 Krull
(Continued)

FOREIGN PATENT DOCUMENTS

DE 3332150 A1 3/1985
SU 1389789 A2 4/1988
WO 2007143802 A1 12/2007

OTHER PUBLICATIONS

International Search Report (Aug. 29, 2014) for corresponding International App. PCT/IB2014/000761.

*Primary Examiner* — Sundhara Ganesan
*Assistant Examiner* — Jennifer M Deichl
(74) *Attorney, Agent, or Firm* — WRB-IP LLP

(57) ABSTRACT

A weight selector apparatus includes a tube including a radially extending through opening, a body non-rotatably disposed inside the tube, a finger pivotably mounted on the body and adapted to be pivoted relative to the body between a first finger position inside the tube and a second finger position in which a portion of the finger extends outside of the tube through the radially extending through opening. A rod can be provided that has a finger engaging portion in engagement with a rod engaging portion of the finger, the rod being rotatable relative to the tube between a first rotated position in which the rod causes the finger to pivot to the first finger position and a second rotated position in which the rod causes the finger to pivot to the second finger position, and an arrangement for rotating the rod relative to the tube. A weight lifting arrangement including such a weight selector apparatus is also provided.

18 Claims, 9 Drawing Sheets

(56) References Cited

U.S. PATENT DOCUMENTS

| | | | | |
|---|---|---|---|---|
| 2006/0240958 | A1* | 10/2006 | Liu | A63B 21/075<br>482/107 |
| 2011/0045956 | A1* | 2/2011 | Colledge | A63B 21/0728<br>482/107 |
| 2013/0237390 | A1* | 9/2013 | Lo | A63B 21/00065<br>482/98 |

* cited by examiner

WEIGHT LIFTING ARRANGEMENT AND WEIGHT SELECTOR APPARATUS FOR A WEIGHT LIFTING ARRANGEMENT

BACKGROUND AND SUMMARY

The present invention relates generally to weight selector apparatus for selecting a desired number of weights from a stack of weights in a weight lifting arrangement.

Various arrangements are known for selecting a desired number of weights from a stack at weights in weight lifting apparatus. Perhaps the most common arrangement involves a pin that is caused to extend through or under a weight in a stack of weights and into a rod or tube that is attached to a cable that a user pulls on to perform a weight lifting exercise.

According to an aspect of the present invention, a weight selector apparatus comprises a tube comprising a radially extending through opening, a body non-rotatably disposed inside the tube, and a finger pivotably mounted on the body and adapted to be pivoted relative to the body between a first finger position inside the tube and a second finger position in which a portion of the finger extends outside of the tube through the radially extending through opening.

According to another aspect of the invention, a weight lifting arrangement comprises a stack of a plurality of weights disposed one on top of another, the stack of weights having a passage extending, from a top to a bottom of the stack, the passage being defined, by an opening in each weight of the stack of weights. The weight lifting arrangement further comprises a weight selector apparatus, comprising a tube comprising, a plurality of radially extending through openings, the tube being axially movably disposed in the passage between a first tube position in which the tube extends through the entire passage and a second position in which the tube is disposed outside of the passage, wherein, when the tube is in the first tube position, at least some of the radially extending through openings align with recesses in corresponding ones of the weights of the stack of weights, a body non-rotatably disposed inside the tube, and a finger pivotally mounted on the body and adapted to be pivoted relative to the body between a first finger position inside the tube and a second finger position in which a portion of the finger extends outside of the tube through a desired one of the radially extending through openings and into a recess in a weight of the stack of weights that corresponds to the desired one of the radially extending through openings.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
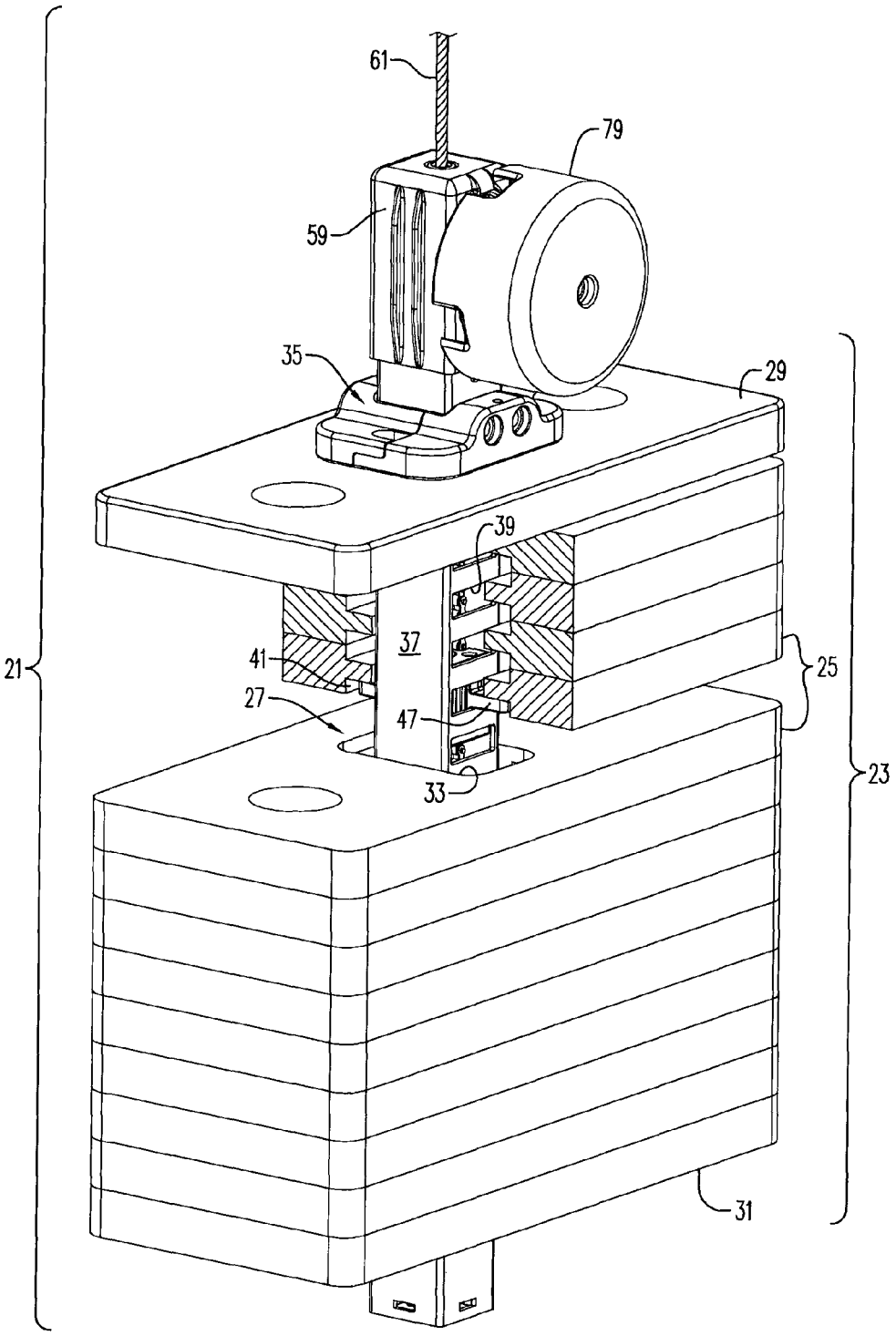
FIG. 1 is a partially cross-sectional, perspective view of a portion of a weight lifting arrangement according to an aspect of the present invention.

FIG. 1 shows a weight lifting arrangement 21 according to an aspect of the present invention. The weight lifting arrangement 21 comprises a stack 23 of a plurality of weights 25 disposed one on top at another. The stack 23 of weights 25 has a passage 27 extending from a top 29 to a bottom 31 of the stack. The passage 27 is defined by an opening 33 in each weight 25 of the stack 23 of weights. Ordinarily, each weight 25 is identical to every other weight in the stack 23, however, this is not necessarily the case, and weights of different sizes may be combined in stack.

The weight lifting arrangement 21 comprises a weight selector apparatus 35 seen without the stack 23 of weights 25 in FIGS. 2-5. The weight selector apparatus 35 comprises a tube 37 (FIGS. 1 and 2) comprising at least one and, more typically, a plurality of radially extending through openings 39. The tube 37 is axially movably disposed in the passage 27 between a first tube position in which the tube extends through the entire passage and a second position in which the tube is disposed outside of the passage, usually as the result of having been completely lifted out of the passage from bottom to top. When the tube 37 is in the first tube position, at least some of the radially extending through openings 39 align with recesses 41 ((FIG. 1) in corresponding ones of the weights 25 of the stack of weights 23. Ordinarily, each of the weights in the stack 23 has a recess 41 that aligns with a corresponding through opening 39 in the tube 37.

Figure 2:
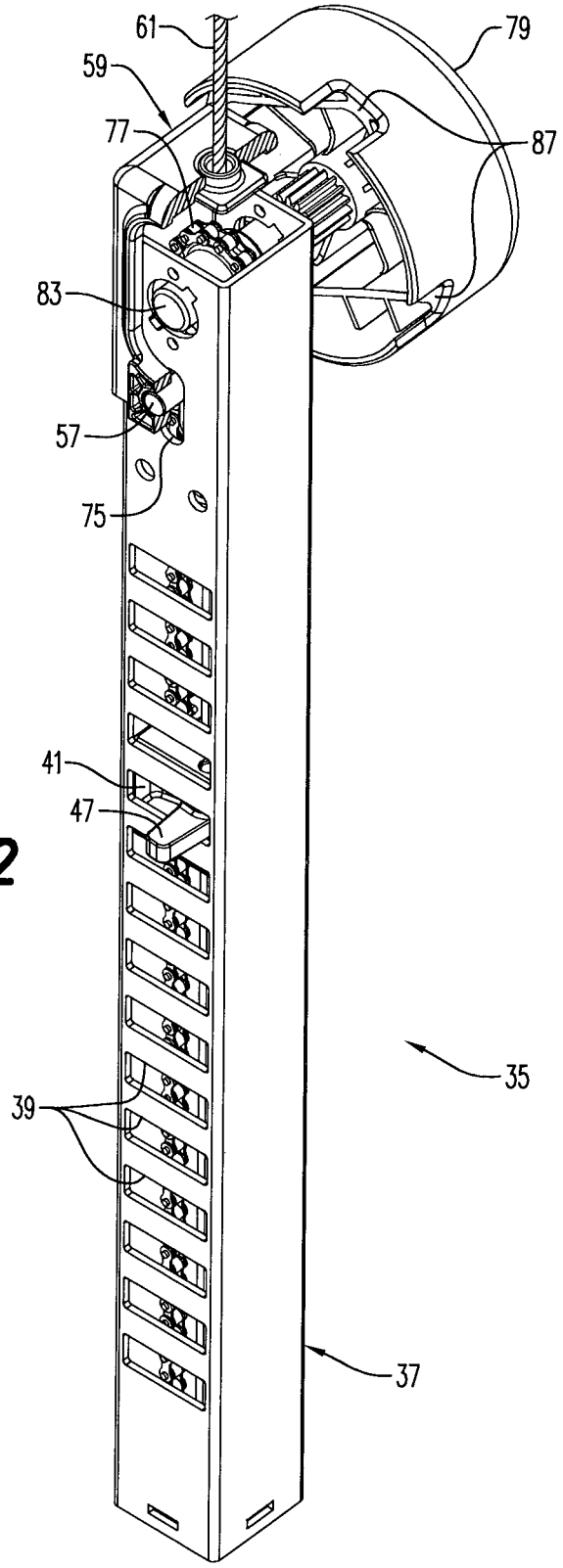
FIG. 2 is a partially cross-sectional, perspective view of a portion of a weight selector apparatus for a weight lifting arrangement according to an aspect of the present invention.
Figure 3:
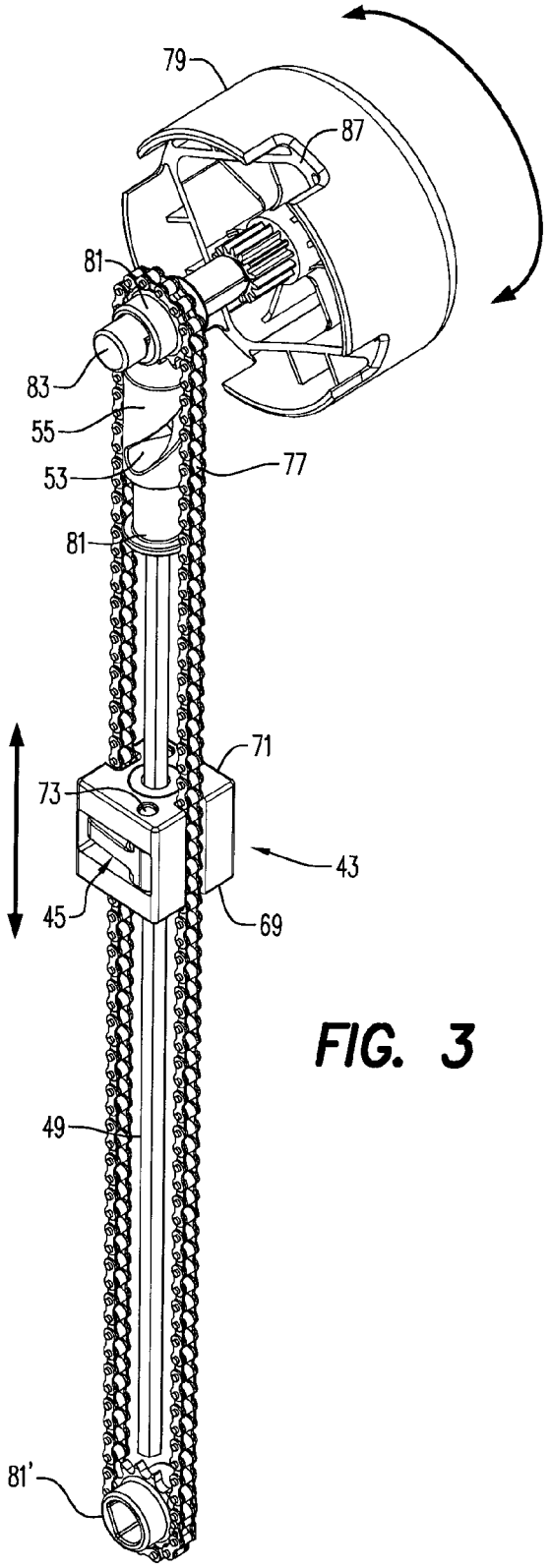
FIGS. 3 and 4 are partially cross-sectional, perspective views of portions of a weight selector apparatus for a weight lifting arrangement according to an aspect of the present invention with an outer tube portion of the apparatus removed.
Figure 4:
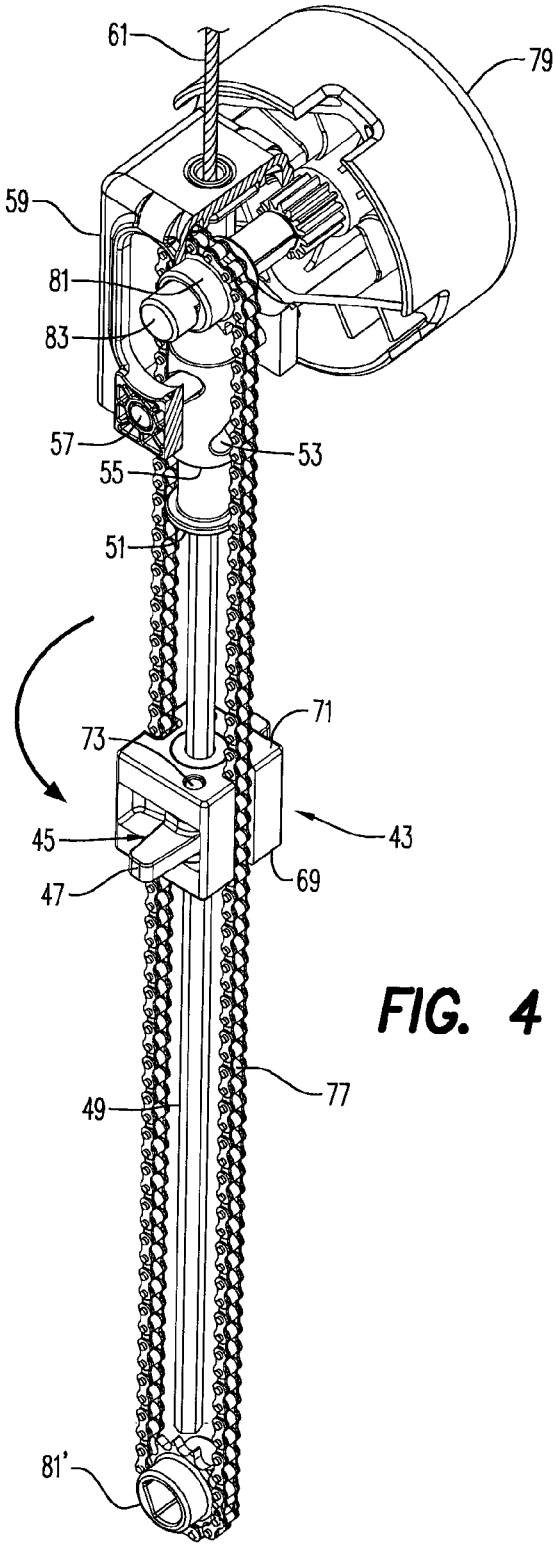
Figure 5:
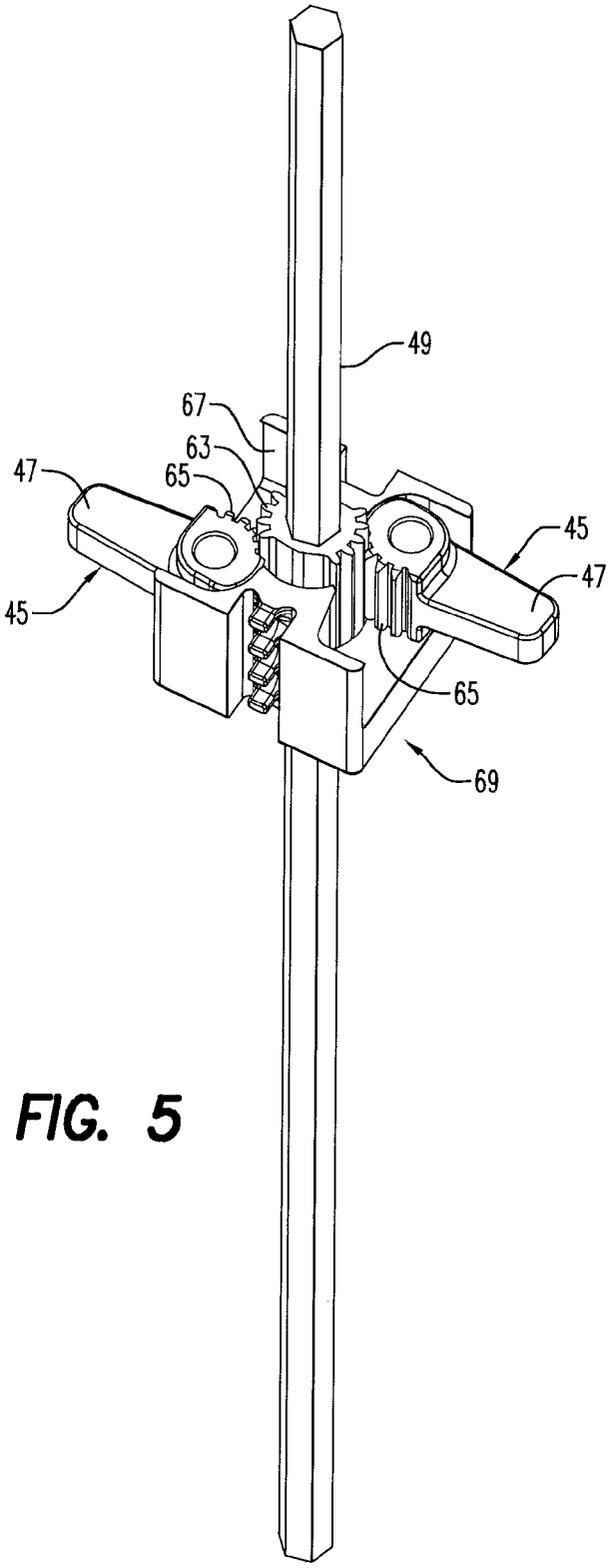
FIG. 5 is a perspective view of a portion of a rod and a portion of a body of the weight selector apparatus for a weight lifting arrangement according to an aspect of the present invention.

The weight selector apparatus 35 further comprises a body 43 that is non-rotatably disposed inside the tube 37. The body 43 may, for example, have, a non-circular external shape and the tube 37 may have a matching non-circular internal shape to permit axial but not rotational movement of the body relative to the tube. As seen in FIGS. 3-5, showing portions of the weight selector apparatus 35 disposed inside of the tube 37 without also showing the tube, a finger 45 is pivotably mounted on the body 43 and is adapted to be pivoted relative to the body between a first finger position seen in FIG. 3 in which the finger is disposed inside the tube and, ordinarily, inside of the body 43, and a second finger position seen in FIGS. 1, 2, 4, and 5 in which a portion 47 of the finger extends outside of the tube 37 through a desired one of the radially extending through openings 39 and, as seen in FIG. 1, into a recess 41 in a weight 25 of the stack 23 of weights that corresponds to the desired one of the radially extending through openings. When the portion 47 of the finger 45 is received in the recess 41 in the weight 25 of the stack of weights, the weights disposed vertically above the finger can be lifted by lifting the tube 37. Ordinarily, a plurality of fingers 45 are pivotably mounted on the body 43, such as two on opposite sides, with each finger being adapted to be pivoted relative to the body between the first finger position inside the tube and the second finger position in which the portion 47 of the finger extends outside of the tube through the radially extending through opening 39.

The weight selector apparatus 35 further comprises a rod 49 having a finger engaging portion in engagement with a rod engaging portion of the finger 45. The rod 49 is rotatable relative to the tube 37 between a first rotated position seen in FIG. 3 in which the rod causes the finger 47 to pivot to the first finger position and a second rotated position seen in FIG. 4 in which the rod causes the finger to pivot to the second finger position.

Means for rotating the rod 49 relative to the tube 37 are provided. Various suitable means can be provided, such as bevel gears on the rod 49 and a shaft (not shown) extending into the tube 37. In a presently preferred means for rotating the rod 49, the tube 37 and the rod are substantially axially immovable relative to each other, such as by providing a flange 51 on the rod that is prevented from moving downwardly through an opening (not shown) defined by a structure such as a plate attached or fixed to an interior of the tube. A helical groove 53 is provided in a top portion 55 of the rod 49. A pin 57 is disposed in the helical groove 53 and is movable vertically upward and downward relative to the tube 37 in a direction of a longitudinal axis of the tube between a first pin position in which the pin is disposed relative to the tube so that the rod is rotated to the first rotated position (e.g., FIG. 3) and a second pin position seen in FIG. 4 in which the pin is disposed relative to the tube so that the rod is rotated to the second rotated position.

When the pin 57 travels vertically upwardly or downwardly relative to the tube 37, because it travels in the helical groove 53 of the rod 49, the movement of the pin causes the rod to rotate relative to the tube. The pin 57 only travels vertically upwardly and downwardly relative to the tube 37 and does not move circumferentially relative to the tube. The pin 57 can be mourned on a frame 59 attached to the tube 37. The frame 59 is ordinarily attached to the tube 37 so that it is only movable relative to the tube a limited distance from a lowermost first frame position to an uppermost second frame position (FIGS. 1, 2, 4) to move the pin from the first pin position to the second pin position. For example, the pin 57 can be disposed in a slot 75 in a wall of the tube 37. When the pin 57 is at the lowermost pan of the slot 75, the frame 59 is in the first frame position and, when the pin 5 is at the uppermost part of the slot, the frame is in the second frame position. As seen in FIGS. 1, 2, and 4, the frame 59 and tube 37 can have corresponding non-circular interior and exterior surfaces that prevent rotation of the frame (and the pin 57) relative to the tube.

Ordinarily, a cable 61 is attached to the frame 59. Pulling the cable 61 in a direction away from the tube 37 moves the frame 59 from the first frame position to the second frame position. Ordinarily, a spring (not shown) is disposed between surfaces of the frame 59 and the tube 37 for urging the frame to the first frame position. Pulling the cable 61 in a direction away from the tube 37 moves the frame 59 from the first frame position to the second frame position against a force of the spring and, when force on the cable is released, the spring returns the frame 59 to the first frame position. If desired, the spring can be omitted and the frame 59 can be allowed, to return to the first frame position under the force of gravity, or by being manually pushed downward relative to the tube 37. The cable 61 will ordinarily be attached to a handle or other structure to be held by a person using the weight lifting arrangement 21. The cable 61 will ordinarily extend around one or more pulleys (not shown)

As seen in FIG. 5, the finger engaging portion of the rod 49 (top portion 55 not shown in FIG. 5) and the rod engaging portion of the finger 45 can comprise gears 63 and 65, respectively. A gear 63 forming the finger engaging portion of the rod 49 is ordinarily axially movable and non-rotatable relative to the rod and is retained in a space 67 inside the body 43. The body 43 can comprise a lower shell portion 69 (FIG. 5) to which an upper shell portion 71 (FIGS. 3 and 4) can be attached. The finger 45 can be attached in the space 67 in the body 43 via pins 73 extending at least partially through the body.

Instead of the finger 45 that is pivoted out of the body 43, other suitable structures can be provided. For example, the rod 49 can function as a cam and be, for example, substantially oval in shape such that, when rotated to one orientation relative to the body 43, the rod can force a spring loaded pin out of the body against the force of a spring and, when rotated to another orientation, the rod does not force the pin out of the body and the spring urges the pin to a position inside of the body.

The tube 37 ordinarily comprises a plurality of radially extending through openings 39 arranged along an axial length of the tube. The body 43 is ordinarily movable axially inside of the tube 37. The weight selector apparatus 21 ordinarily comprises a drive element 77 fixed to the body 43, and means for moving the drive element to move the body axially inside of the tube to align the finger 45 with a desired one of the radially extending through openings 39. The drive element 77 can comprise at endless drive element such as a chain (as shown in FIGS. 3 and 4), a rope, belt, or the like. The moving means can comprise a knob 79 for turning a member 81 such as a sprocket around which the drive element extends. The member 81 can be rotatably mounted on the tube 37 on a shaft 83 that turns the member by turning the knob 79. A second member 81 around which the drive element 77 can extend can be rotatably mounted at a lower point in the tube 37.

Means can be provided for indexing the body 43 in a plurality of positions relative to the tube 37 in which the finger 45 is aligned with one of the radially extending through openings. The indexing means can comprise a variety of suitable structures. A presently preferred structure comprises a spring loaded member (not shown) mounted on the tube 37 or the frame 59 that is received in a recess in a portion of the knob 79 when the body 43 is disposed in a position relative to the tube 37 in which the finger 45 is aligned with one of the through openings in the tube. Windows 87 can be provided in the knob 79 to reflect proper alignment of the body 43 in one of a plurality of positions relative to the tube 37 and an amount of weight that would be lifted at that position.

Figure 6:
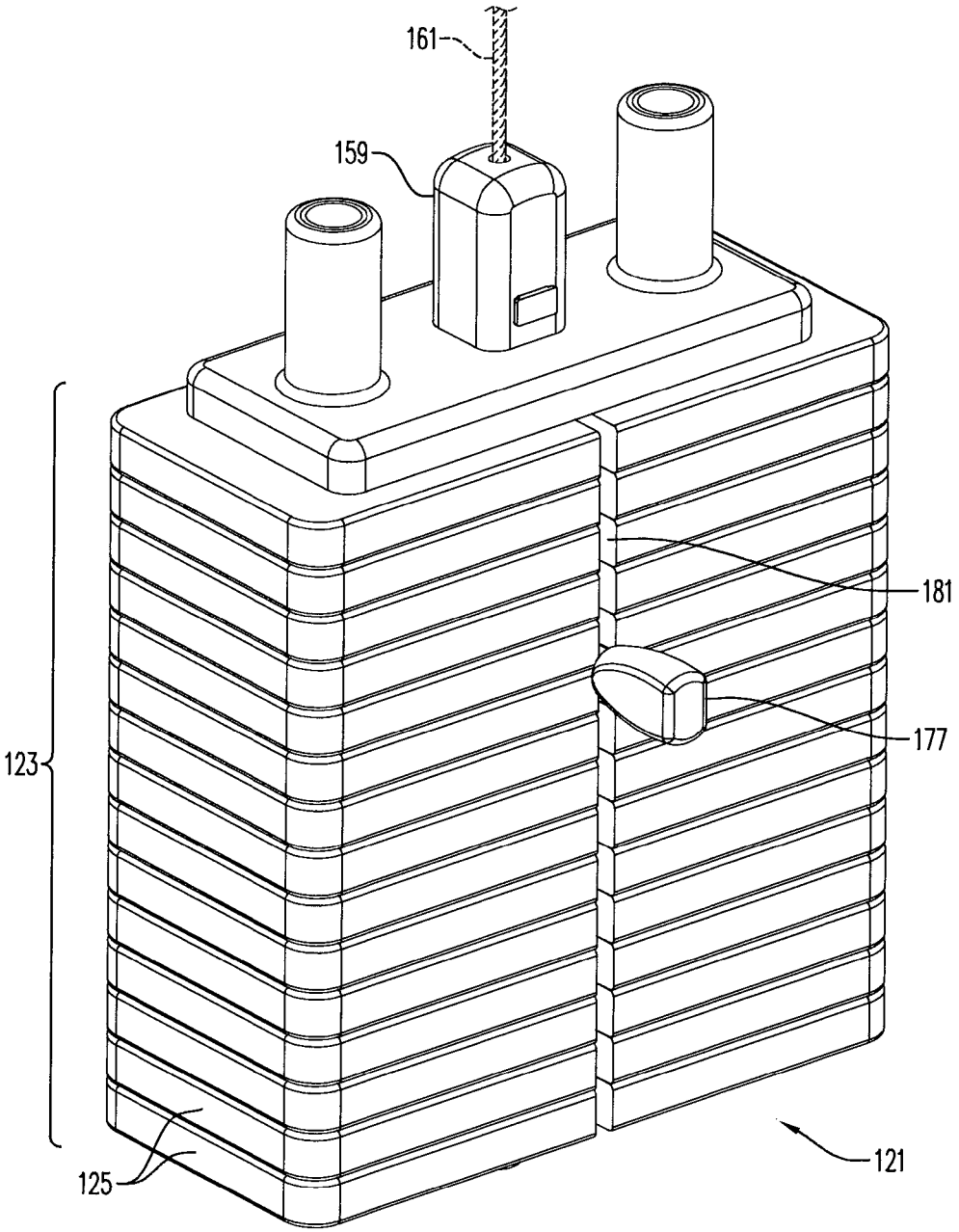
FIG. 6 is a perspective view of a portion of a weight lifting arrangement according to another aspect of the present invention.
Figure 7:
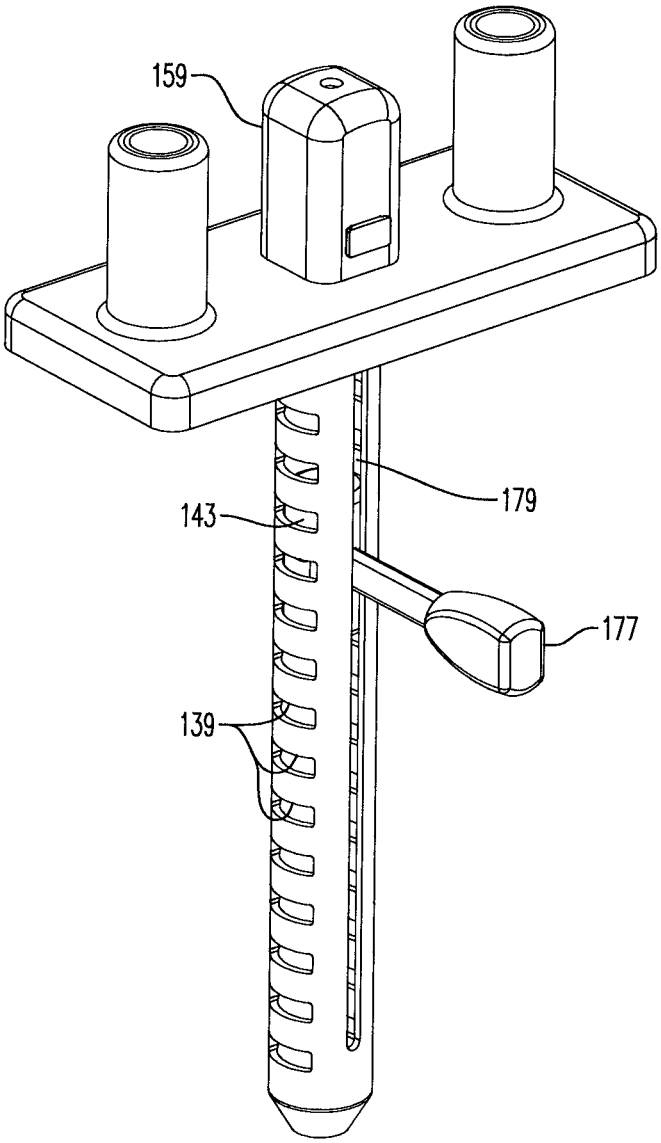
FIG. 7 is a perspective view of a portion of a weight lifting arrangement according to another aspect of the present invention.
Figure 8:
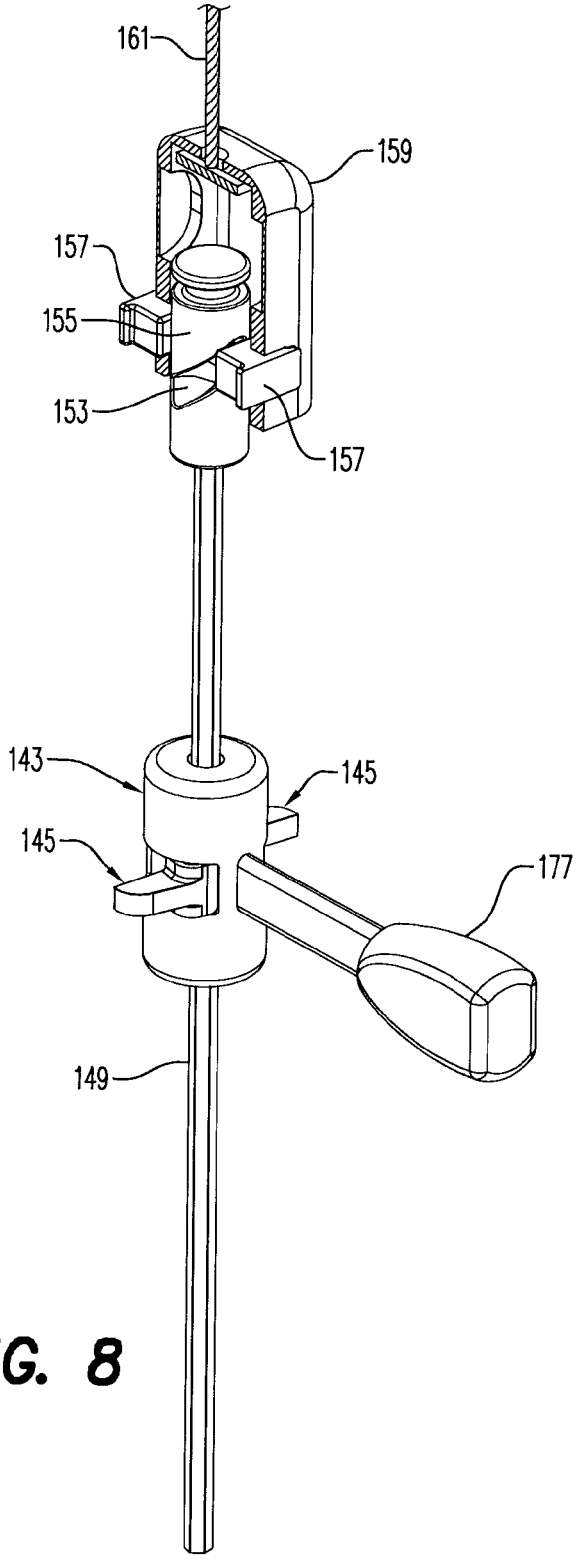
FIGS. 8-10 are partially cross-sectional, perspective views of a portion of a weight lifting arrangement according to an aspect of the present invention.
Figure 9:
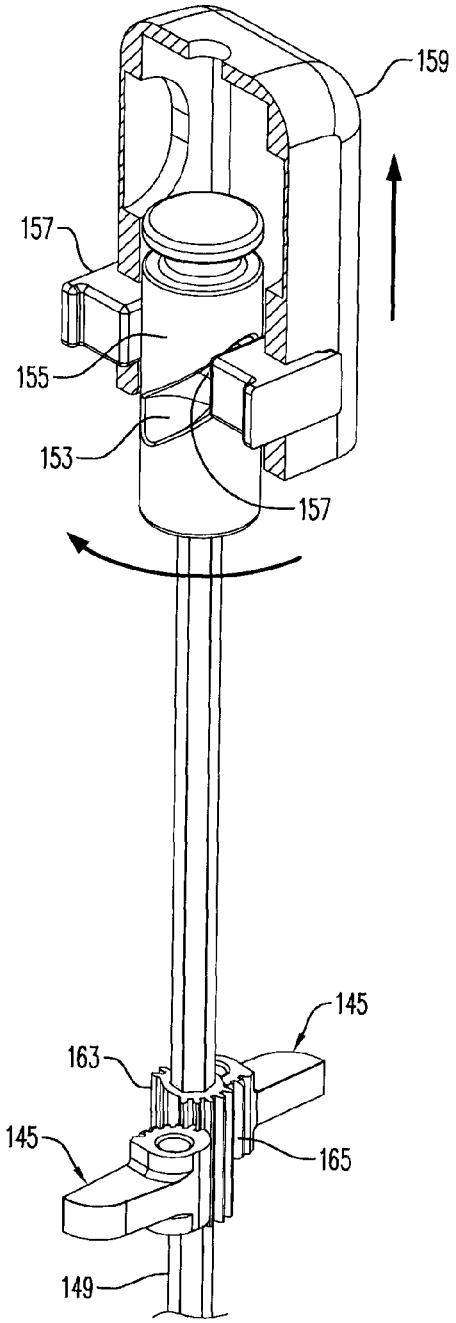
Figure 10:
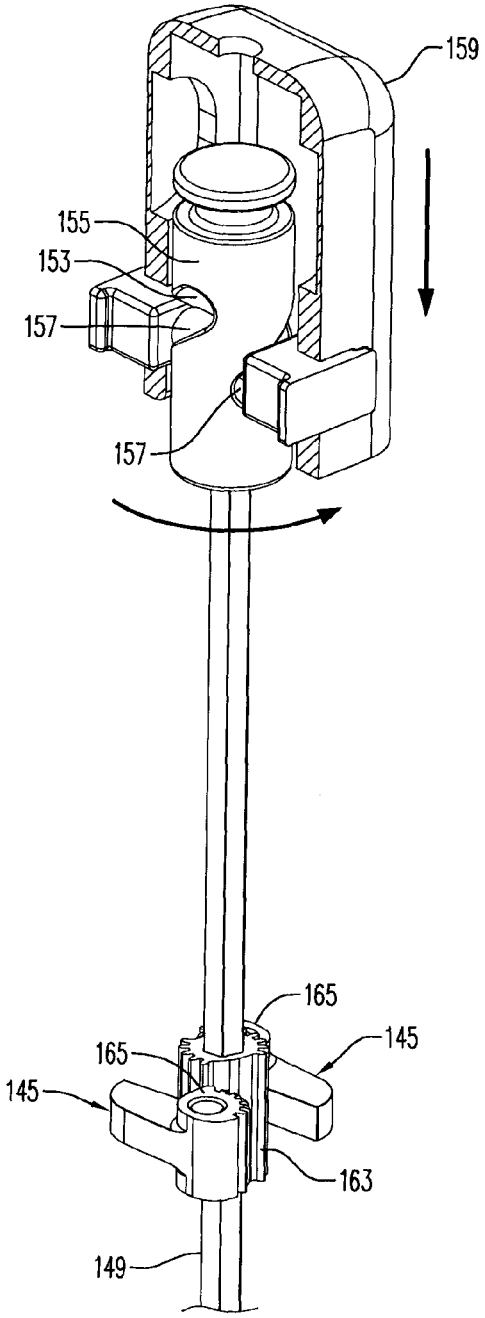

Other arrangements for moving the body can be provided as well. For example, as seen by the weight lifting arrangement 121 shown in FIGS. 6-10, instead of drive element 77 and knob 79, the body 143 (FIGS. 7 and 8) can be manually moved by an arm 177 extending from the body and extending through an axially extending channel 179 in the tube 137 (FIG. 7) and channels 181 (FIG. 6) in the weights 125 forming the stack 123 (FIG. 6) of weights so that an end of the arm extends beyond the periphery of the stack of weights. By moving the arm 177, and thus the body 143, up and down relative to the tube 137 and the stack 123 of weights 125, the body can be positioned at any desired relative position. As seen in FIGS. 8-10, the finger 145 or fingers can be pivoted relative to the body 143 and out of the openings 139 in the tube 137 by pulling on the cable 161 (shown in phantom in FIG. 6) to raise a frame 159 with pins 157 thereon relative to a helical groove 153 in a top portion 155 of a rod 149 during a weight lifting movement as in the embodiment using the drive element 77 and knob 79. The raising of the frame 159 relative to the rod 149 as in FIG. 8 causes the rod to rotate so that a gear 163 (FIGS. 9-10) on the rod that engages with gears 165 on a rod engaging portion of the fingers 145 causes the fingers to pivot outwardly from the body 143 to the position shown by FIGS. 8 and 9. As with the drive element 77 and knob 79 arrangement, upon releasing of the upward force on the frame 159, the fingers 145 can be pivoted inwardly to the position shown in FIG. 10 by the frame being urged downward relative to the rod 149 either by a spring (not shown), gravity, manual pressure, or other suitable means. An arrangement such as a spring-loaded indexing arrangement (not shown) can be provided on the body 143 and tube 137 to index, the body in appropriate positions relative to the tube for picking up weights. It will be observed that, in the embodiment shown in FIGS. 6-10, the tube 137 and body 143 may be of generally circularly cylindrical shapes, however, they are non-rotatable relative to each other by virtue of the arm 177 extending through the channel 179 in the tube.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A weight selector apparatus, comprising:
a tube comprising a radially extending through opening;
a body non-rotatably disposed and axially movable inside the tube; and
a finger pivotably mounted on the body and adapted to be pivoted relative to the body about an axis parallel to a longitudinal axis of the tube between a first finger position inside the tube and a second finger position in which a portion of the finger extends outside of the tube through the radially extending through opening.

2. The weight selector apparatus as set forth in claim 1, comprising a rod having a finger engaging portion in engagement with a rod engaging portion of the finger, the rod being rotatable relative to the tube between a first rotated position in which the rod causes the finger to pivot to the first finger position and a second rotated position in which the rod causes the finger to pivot to the second finger position, and means for rotating the rod relative to the tube.

3. The weight selector apparatus as set forth in claim 1, comprising a plurality of fingers pivotably mounted on opposite sides of the body, each finger being adapted to be pivoted relative to the body between the first finger position inside the tube and the second finger position in which the portion of the finger extends outside of the tube through the radially extending through opening.

4. The weight selector apparatus as set forth in claim 1, wherein the body has a non-circular external shape and the tube has a matching non-circular internal shape.

5. A weight selector apparatus, comprising:
a tube comprising a radially extending through opening;
a body non-rotatably disposed inside the tube;
a finger pivotably mounted on the body and adapted to be pivoted relative to the body between a first finger position inside the tube and a second finger position in which a portion of the finger extends outside of the tube through the radially extending through opening; and
a rod having a finger engaging portion in engagement with a rod engaging portion of the finger, the rod being rotatable relative to the tube between a first rotated position in which the rod causes the finger to pivot to the first finger position and a second rotated position in which the rod causes the finger to pivot to the second finger position, and means for rotating the rod relative to the tube, wherein the tube and the rod are substantially axially immovable relative to each other, and wherein the rod rotating means comprises a helical groove in the rod and a pin disposed in the helical groove and movable relative to the tube in a direction of a longitudinal axis of the tube between a first pin position in which the pin is disposed relative to the tube so that the rod is rotated to the first rotated position and a second pin position in which the pin is disposed relative to the tube so that the rod is rotated to the second rotated position.

6. The weight selector apparatus as set forth in claim 5, wherein the pin is mounted on a frame attached to the tube, the frame being movable from a first frame position to a second frame position relative to the tube to move the pin from the first pin position to the second pin position.

7. The weight selector apparatus as set forth in claim 6, comprising a cable attached to the frame, wherein, pulling the cable in a direction away from the tube moves the frame from the first frame position to the second frame position.

8. The weight selector apparatus as set forth in claim 6, comprising a spring disposed between the frame and the tube for urging the frame to the first frame position.

9. The weight selector apparatus as set forth in claim 8, comprising a cable attached to the frame, wherein, pulling the cable in a direction away from the tube moves the frame from the first frame position to the second frame position against a force of the spring.

10. A weight selector apparatus, comprising:
a tube comprising a radially extending through opening;
a body non-rotatably disposed inside the tube;
a finger pivotably mounted on the body and adapted to be pivoted relative to the body between a first finger position inside the tube and a second finger position in which a portion of the finger extends outside of the tube through the radially extending through opening; and
a rod having a finger engaging portion in engagement with a rod engaging portion of the finger, the rod being rotatable relative to the tube between a first rotated position in which the rod causes the finger to pivot to the first finger position and a second rotated position in which the rod causes the finger to pivot to the second finger position, and means for rotating the rod relative to the tube,
wherein the finger engaging portion of the rod and the rod engaging portion of the finger comprise gears.

11. The weight selector apparatus as set forth in claim 10, wherein a gear forming the finger engaging portion of the rod is axially movable and non-rotatable relative to the rod.

12. The weight selector apparatus as set forth in claim 11, wherein the gear forming the finger engaging portion of the rod is retained in a space inside the body.

13. A weight selector apparatus, comprising:

a tube comprising a radially extending through opening;

a body non-rotatably disposed inside the tube;

a finger pivotably mounted on the body and adapted to be pivoted relative to the body between a first finger position inside the tube and a second finger position in which a portion of the finger extends outside of the tube through the radially extending through opening; and a rod having a finger engaging portion in engagement with a rod engaging portion of the finger, the rod being rotatable relative to the tube between a first rotated position in which the rod causes the finger to pivot to the first finger position and a second rotated position in which the rod causes the finger to pivot to the second finger position, and means for rotating the rod relative to the tube, wherein the tube comprises a plurality of radially extending through openings arranged along an axial length of the tube and the body is movable axially inside of the tube, the apparatus comprising a drive element fixed to the body, and means for moving the drive element to move the body axially inside of the tube to align the finger with a desired one of the radially extending through openings.

14. The weight selector apparatus as set forth in claim 13, wherein the drive element comprises an endless drive element and the moving means comprises a knob for turning a member around which the drive element extends.

15. The weight selector apparatus as set forth in claim 14, wherein the member is rotatably mounted on the tube.

16. The weight selector apparatus as set forth in claim 13, comprising means for indexing the body in a plurality of positions relative to the tube in which the finger is aligned with one of the radially extending through openings.

17. A weight lifting arrangement, comprising:

a stack of a plurality of weights disposed one on top of another, the stack of weights having a passage extending from a top to a bottom of the stack, the passage being defined by an opening in each weight of the stack of weights; and a weight selector apparatus, comprising a tube comprising a plurality of radially extending through openings, the tube being axially movably disposed in the passage between a first tube position in which the tube extends through the entire passage and a second position in which the tube is disposed outside of the passage, wherein, when the tube is in the first tube position, at least some of the radially extending through openings align with recesses in corresponding ones of the weights of the stack of weights, a body non-rotatably disposed and axially movable inside the tube, and a finger pivotably mounted on the body and adapted to be pivoted relative to the body about an axis parallel to a longitudinal axis of the tube between a first finger position inside the tube and a second finger position in which a portion of the finger extends outside of the tube through a desired one of the radially extending through openings and into a recess in a weight of the stack of weights that corresponds to the desired one of the radially extending through openings.

18. The weight lifting arrangement as set forth in claim 17, comprising a rod having a finger engaging portion in engagement with a rod engaging portion of the finger, the rod being rotatable relative to the tube between a first rotated position in which the rod causes the finger to pivot to the first finger position and a second rotated position in which the rod causes the finger to pivot to the second finger position, and means for rotating the rod relative to the tube.

* * * * *